United States Patent [19]

Schelle

[11] 4,166,608

[45] Sep. 4, 1979

[54] JACK ATTACHMENT AND METHOD OF TRANSMISSION REMOVAL

[76] Inventor: Charles J. Schelle, 1817 Estella, Perry, Iowa 50220

[21] Appl. No.: 893,343

[22] Filed: Apr. 4, 1978

[51] Int. Cl.[2] ..... B66F 3/00

[52] U.S. Cl. ..... 254/133 R

[58] Field of Search ..... 254/133, 134

[56] References Cited

U.S. PATENT DOCUMENTS

| | | | |
|---|---|---|---|
| 2,940,611 | 6/1960 | Burch | 254/134 |
| 3,095,182 | 6/1963 | Platt | 254/134 |

*Primary Examiner*—Robert C. Watson

*Attorney, Agent, or Firm*—Gary L. McMinimee

[57] ABSTRACT

A novel attachment for a motor vehicle transmission jack of the type having a lift arm adapted to raise and lower motor vehicle transmission parts at its forward end. The attachment is adapted to support a fully assembled 4-wheel drive transmission unit, including the transfer case and the motor vehicle transmission support bracket, independently of a motor vehicle. The attachment includes a base member adapted to be connected to the forward portion of the lift arm and having a support portion adapted to supportably engage the motor vehicle transmission support bracket substantially vertical of the forward end of said lift arm. The attachment also includes a forward support member rigidly secured to the base member, having a support portion adapted to supportably engage the forward portion of the transmission. The support portions of the base member and the forward support member are spaced relative to each other to support the motor vehicle transmission unit in a substantially horizontal position.

The method of removing a fully assembled 4-wheel drive transmission unit, including the transfer case and the motor vehicle transmission support bracket, from a motor vehicle utilizing this type of transmission jack and attachment includes positioning the jack under the transmission unit. The method further includes activating the jack to substantially simultaneously supportably engage the motor vehicle transmission support bracket and the forward portion of the transmission, disconnecting the transmission unit from the motor vehicle drive train and disconnecting the motor vehicle transmission support bracket from the motor vehicle.

7 Claims, 2 Drawing Figures

JACK ATTACHMENT AND METHOD OF TRANSMISSION REMOVAL

BACKGROUND OF THE INVENTION

This invention relates to an attachment for a motor vehicle transmission jack and more particularly to such an attachment adapted to support 4-wheel drive transmission units independently of the motor vehicle during removal and installation as well as repair.

Repair of model 350 and 400 turbo hydromatic transmissions for 4-wheel drive vehicles such as 1973 through 1978 half and three-quarter ton Chevrolet and GMC trucks has required removal of the transmission from the vehicles themselves. Instructions issued by the manufacturers of these vehicles direct that transfer case be removed separately from the remainder of the transmission unit. Accepted time for such removal and installation using the foregoing method has ranged from four to five and one-half hours; utilizing the novel attachment and method of this invention, the time for removal and installation is reduced to about two hours.

SUMMARY OF THE INVENTION

The present invention relates to a novel attachment for a motor vehicle transmission jack of the type having a lift arm adapted to raise and lower motor vehicle transmission parts at its forward end. The attachment is adapted to support a fully assembled 4-wheel drive transmission unit, including the transfer case and the motor vehicle transmission support bracket, independently of a motor vehicle. The attachment includes a base member adapted to be connected to the forward portion of the lift arm and having a support portion adapted to supportably engage the motor vehicle transmission support bracket substantially vertical of the forward end of said lift arm. The attachment also includes a forward support member rigidly secured to the base member, having a support portion adapted to supportably engage the forward portion of the transmission. The support portions of the base member and the forward support member are spaced relative to each other to support the motor vehicle transmission in a substantially horizontal position.

The method of removing a fully assembled 4-wheel drive transmission unit, including the transfer case and the motor vehicle transmission support bracket, from a motor vehicle utilizing this type of transmission jack and attachment includes positioning the jack under the transmission unit. The method further includes activating the jack to substantially simultaneously supportably engage the motor vehicle transmission support bracket and the forward portion of the transmission, disconnecting the transmission from the motor vehicle drive train and disconnecting the motor vehicle transmission support bracket from the motor vehicle.

DESCRIPTION OF THE DRAWINGS

In the drawings which illustrate a preferred embodiment of the novel attachment for motor vehicle transmission jacks.

DESCRIPTION OF PREFERRED EMBODIMENT

Figure 1:
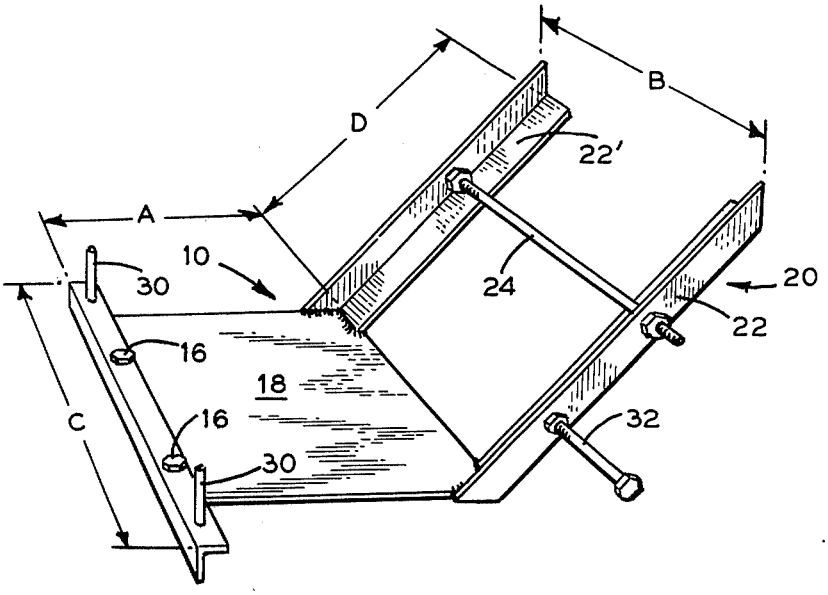
FIG. 1 is a prospective view of the novel attachment separate of a transmission jack.

The novel jack attachment 10 is shown in the drawings mounted on a motor vehicle transmission jack 12.

The transmission jack 12 is of the common type having a lift arm 14 adapted to raise and lower transmission parts at its forward end. A typical example of such a jack 12 is Hein Warner model 54.

The attachment 10 may be secured to the jack 12 by any convenient means; in the drawings the attachment 10 is shown as being secured to jack 12 by bolts 16.

The attachment 10 includes a base member 18 and a forward support member 20. The support member 20 is shown as including a pair of forwardly and upwardly extending elongated members 22 and 22' rigidly secured to base member 18 and further including a cross member 24 rigidly secured to the elongated members 22 and 22' intermediate their ends.

Figure 2:
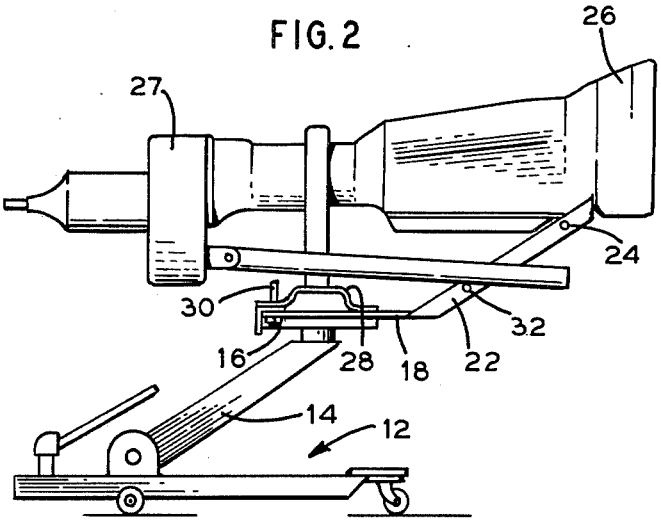
FIG. 2 is a side elevation view of the novel attachment mounted on a transmission jack and supporting a 4-wheel drive motor vehicle transmission unit.

As best illustrated in FIG. 2, the jack attachment 10 is adapted to support a fully assembled 4-wheel drive transmission 26, including the transfer case 27 and the motor vehicle transmission support bracket 28. The forward portion of the elongated members 22 and 22' are adapted to supportably engage the forward casing of the transmission 26 and the base member 18 is adapted to supportably engage the transmission support bracket 28.

The attachment 10 also is shown as including a means for positioning the transmission 26 relative to the attachment 10 and the jack arm 14. It is generally desirable that the transmission 26 be positioned on the attachment 10 so that the support bracket 28 is substantially vertical of the forward portion of jack arm 14. This assures good balance of the assembly.

In the drawings the positioning means is shown as a pair of upright guide pegs 30 welded to the rear portion of base member 18 and adapted to be received through guide holes in bracket 28. With respect to model 350 and 400 turbo-hydromatic transmissions used in 1973 through 1978 Chevrolet and GMC three-quarter ton and half ton trucks, it is generally not required that the guide holes be drilled in bracket 28 in that such bracket as manufactured generally have such guide holes. Such guide holes are centered with respect to the transmission and are spaced apart approximately 15 inches. If the guide pegs 30 are sufficiently long, e.g., one and one-half inches, the forward end of the transmission 26 may be tipped rearwardly and upwardly about an axis through the support bracket 28 without danger of the transmission 26 dropping from the attachment 10; this is often desirable during repairs of the transmission 26.

It is desirable that the attachment 10 be adapted to hold the transmission 26 in a substantially horizontal position which is approximately the same position transmission 26 is mounted in the motor vehicle. It is further desirable that the elongated members 22 and 22' have such lengths, extend at such an angle and be so spaced apart that they engage the casing so that they do not interfere with the removal of the transmission 26 from the motor vehicle.

The attachment 10 is also shown as including a drive shaft support member 32 which keeps the forward drive shaft conveniently secured during removal, installation and repair.

For model 350 and 400 turbo-hydromatic transmissions found in 1973 through 1978 Chevrolet and GMC half-ton and three-quarter ton 4-wheel drive trucks, an attachment 10 having the following dimensions has been found to be particularly suitable:

"A"—9¼ inches;
"B"—12¼ inches;
"C"—18 inches;
"D"—14¾ inches.

Utilizing the above dimensions and one and one-half inch angle iron to form elongated members 22 and 22', a suitable angle between the base member 18 and the elongated members 22 and 22' is 143 degrees.

The method for removing a fully assembled 4-wheel drive transmission 26 from a motor vehicle includes positioning jack 12 mounted with attachment 10 under the transmission unit and activating the jack arm 14 to supportably engage the motor vehicle transmission support bracket 28 and the forward portion of the casing of transmission 26. Since the attachment 10 is adapted to support the transmission 26 in substantially the same position as it is mounted in the motor vehicle, the base 18 and the elongated members 22 and 22' will engage the transmission 26 approximately simultaneously.

In the event the positioning means utilized is guide pegs 30, it may be required to drill guide holes in the bracket 28 in some models prior to positioning and activating the arm 14.

After the jack 12 has been positioned the transmission 26 may be disconnected from the drive train of the vehicle and the motor vehicle transmission support bracket may be disconnected from the vehicle as well. When the transmission 26 is fully disconnected from the motor vehicle, the jack arm 14 is activated to lower the transmission 26; it may then be moved to a convenient work area where the transmission may be repaired.

Installation may be accomplished by following substantially the same procedure in reverse.

Other embodiments of the invention will, of course, be apparent to those skilled in the art.

What is claimed is:

1. An attachment for a motor vehicle transmission jack, said jack being of the type having a lift arm adapted to raise and lower motor vehicle transmission parts at its forward end, the attachment being adapted to support a fully assembled 4-wheel drive transmission unit, including the transfer case and the motor vehicle transmission support bracket, independently of a motor vehicle, the attachment comprising:

a base member, including means for supportably engaging and positioning the motor vehicle transmission support bracket substantially vertically of the forward portion of said lift arm;

means for rigidly connecting said base member to the forward portion of said lift arm; and a forward support means for supportably engaging the forward portion of said motor vehicle transmission and, in conjunction with said base member, for supporting the motor vehicle transmission in a substantially horizontal position, said forward support means including a pair of spaced apart upwardly extending elongated members each rigidly secured to the base member at one end and at the other having means for supportably engaging the forward portion of the transmission.

2. The attachment of claim 1, wherein said positioning means includes a pair of positioning pegs adapted to be received by the said support bracket and to thereby position the transmission on the attachment.

3. The attachment of claim 1, wherein said elongated members extend forward of the base support member.

4. A jack attachment in combination with a motor vehicle transmission jack and a fully assembled 4-wheel drive transmission unit the combination comprising:

a fully assembled 4-wheel drive transmission unit, including a transfer case and a motor vehicle transmission support bracket;

a motor vehicle transmission jack of the type having a lift arm adapted to raise and lower motor vehicle transmission parts at its forward end;

a base member rigidly connected to the forward portion of said lift arm and having a support portion supportably engaging and positioning the motor vehicle transmission support bracket substantially vertically of the forward portion of said lift arm; and a forward support member including a pair of spaced apart upwardly extending elongated members each rigidly secured to the base member at one end and the other end supportably engaging the forward portion of said motor vehicle transmission, said support portions of said base member and said elongated members being spaced relative to each other to support the motor vehicle transmission in a substantially horizontal position.

5. The combination of claim 4, wherein said base member further includes a pair of positioning pegs extending through holes in said support bracket and thereby positioning the transmission on the attachment.

6. The combination of claim 4, wherein said elongated members extend forward of the base member.

7. A method for removing a fully assembled 4-wheel drive transmission unit, including the transfer case and the motor vehicle transmission support bracket, from a motor vehicle, comprising the steps:

positioning a motor vehicle transmission jack under said transmission unit, said transmission jack having an attachment adapted to substantially simultaneously supportably engage the motor vehicle transmission support bracket and the forward portion of said transmission;

activating said jack to supportably engage the motor vehicle transmission support bracket and the forward portion of said transmission;

disconnecting said transmission from the motor vehicle drive train;

disconnecting said motor vehicle transmission support bracket from said motor vehicle; and activating said jack to lower said fully assembled 4-wheel drive transmission unit including the transmission support bracket from the motor vehicle.

* * * * *